US006980948B2

(12) United States Patent
Gao

(10) Patent No.: US 6,980,948 B2
(45) Date of Patent: Dec. 27, 2005

(54) SYSTEM OF DYNAMIC PULSE POSITION TRACKS FOR PULSE-LIKE EXCITATION IN SPEECH CODING

(75) Inventor: Yang Gao, Mission Viejo, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 969 days.

(21) Appl. No.: 09/761,029

(22) Filed: Jan. 16, 2001

(65) Prior Publication Data

US 2002/0095284 A1 Jul. 18, 2002

Related U.S. Application Data

(60) Provisional application No. 60/233,045, filed on Sep. 15, 2000.

(51) Int. Cl.[7] ..... G10L 19/00
(52) U.S. Cl. ..... 703/219; 703/220
(58) Field of Search ..... 704/223, 219, 704/220

(56) References Cited

U.S. PATENT DOCUMENTS 5,327,519 A * 7/1994 Haggvist et al. ..... 704/219
5,867,814 A * 2/1999 Yong ..... 704/216
6,385,574 B1 * 5/2002 Benno ..... 704/221
6,415,252 B1 * 7/2002 Peng et al. ..... 704/208
6,539,349 B1 * 3/2003 Benno ..... 704/219
6,728,669 B1 * 4/2004 Benno ..... 704/219

FOREIGN PATENT DOCUMENTS

EP 0 926 660 A2 6/1999
EP 0 939 394 A1 9/1999
EP 1 083 547 A1 3/2001

OTHER PUBLICATIONS

WO 00 54258 A Sep. 14, 2000.
WO 00 11657 A Mar. 2, 2000.

* cited by examiner

*Primary Examiner*—Daniel Abebe
(74) *Attorney, Agent, or Firm*—Farjami & Farjami LLP

(57) ABSTRACT

A system is disclosed for improving the quality of coded speech information in a communications system. The system dynamically determines pulse tracks that represent an excitation signal. A track or set of tracks that define possible pulse positions are determined based on available information sent to a decoder. Alternatively, at least one first track may include fixed pulse positions, and the remaining tracks may include dynamic pulse positions arranged according to the position of a coded pulse in the first track. Also, all tracks may include dynamically arranged pulse positions that are arranged according to a reference position that is likely to produce a high magnitude pulse signal.

24 Claims, 7 Drawing Sheets

SYSTEM OF DYNAMIC PULSE POSITION TRACKS FOR PULSE-LIKE EXCITATION IN SPEECH CODING

CROSS REFERENCE TO RELATED APPLICATIONS

The present application claims the benefit of U.S. Provisional Application No. 60/233,045, filed Sep. 15, 2000, which is incorporated by reference herein.

The following co-pending and commonly assigned U.S. patent applications were filed on the same day as the above-referenced Provisional Application. All of these applications relate to and further describe other aspects of the embodiments disclosed in this application and are incorporated by reference in their entirety.

U.S. patent application Ser. No. 09/663,242, "SELECTABLE MODE VOCODER SYSTEM," filed on Sep. 15, 2000.

U.S. patent application Ser. No. 09/755,441, "INJECTING HIGH FREQUENCY NOISE INTO PULSE EXCITATION FOR LOW BIT RATE CELP," filed on Sep. 15, 2000.

U.S. patent application Ser. No. 09/771,293, "SHORT TERM ENHANCEMENT IN CELP SPEECH CODING," filed on Sep. 15, 2000.

U.S. patent application Ser. No. 09/782,796, "SPEECH CODING SYSTEM WITH TIME-DOMAIN NOISE ATTENUATION," filed on Sep. 15, 2000.

U.S. patent application Ser. No. 09/761,033, "SYSTEM FOR AN ADAPTIVE EXCITATION PATTERN FOR SPEECH CODING," filed on Sep. 15, 2000.

U.S. patent application Ser. No. 09/782,383, "SYSTEM FOR ENCODING SPEECH INFORMATION USING AN ADAPTIVE CODEBOOK WITH DIFFERENT RESOLUTION LEVELS," filed on Sep. 15, 2000.

U.S. patent application Ser. No. 09/663,837, "CODEBOOK TABLES FOR ENCODING AND DECODING," filed on Sep. 15, 2000.

U.S. patent application Ser. No. 09/662,828, "BIT STREAM PROTOCOL FOR TRANSMISSION OF ENCODED VOICE SIGNALS," filed on Sep. 15, 2000.

U.S. patent application Ser. No. 09/781,735, "SYSTEM FOR FILTERING SPECTRAL CONTENT OF A SIGNAL FOR SPEECH ENCODING," filed on Sep. 15, 2000.

U.S. patent application Ser. No. 09/663,734, "SYSTEM FOR ENCODING AND DECODING SPEECH SIGNALS," filed on Sep. 15, 2000.

U.S. patent application Ser. No. 09/663,002, "SYSTEM FOR SPEECH ENCODING HAVING AN ADAPTIVE FRAME ARRANGEMENT," filed on Sep. 15, 2000.

U.S. patent application Ser. No. 09/940,904, "SYSTEM FOR IMPROVED USE OF PITCH ENHANCEMENT WITH SUBCODEBOOKS," filed on Sep. 15, 2000.

BACKGROUND OF THE INVENTION

1. Technical Field

This invention relates to speech communication systems and, more particularly, to systems for digital speech coding.

2. Related Art

One prevalent mode of human communication is by the use of communication systems. Communication systems include both wireline and wireless radio systems. Data and voice transmissions within a wireless system occur within a bandwidth of an allowed frequency range. Due to increased wireless telecommunication traffic, reduced bandwidth of transmissions to improve capacity with the system is desirable.

Voice and data are transmitted digitally in wireless communications due to noise immunity, reliability, compactness of equipment, and the ability to implement sophisticated signal processing functions using digital techniques. One form of digital transmission is accomplished using digital speech processing systems. Waveforms representing analog speech signals are sampled and then digitally encoded. The number of bits of the encoded signal can be expressed as a bit rate that specifies the number of bits to describe one second of speech. Over the years, significant variations and enhancements have been applied to waveform matching techniques in an effort to improve the quality of the synthesized speech and increase the speech compression.

A reduction in the quality of the synthesized (or reconstructed) speech may occur with respect to the original speech. This divergence in the quality of the synthesized speech is due in part to the failure to closely replicate perceptual aspects of the original speech with the bits of data available to describe the signal. Poor replication of the perceptual aspects could result in noise, loss of clarity, and the failure to capture recognizable characteristics such as tone, pitch and magnitude. These characteristics allow a listener to recognize who the speaker is, as well as providing other perception based features, such as, intelligibility and naturalness of the speech.

Accordingly, there is a need for systems of speech coding that are capable of minimizing the bandwidth of original speech, while providing synthesized speech that closely resembles the original speech and captures the perceptually important features of the speech.

SUMMARY

In many communication systems, an original speech signal is digitized to create a digital speech signal. The digital speech signal may pass through long-term and short-term filters to create a digital excitation signal. The digital excitation signal represents an ideal excitation signal in the form of pulses. The pulses are defined at positions and the positions are divided among tracks to reduce bandwidth. The pulses are encoded at an encoder. The encoded information is sent via a communication link to a decoder to be decoded. The decoded signals represent synthesized speech that is an approximation the original speech signal. Embodiments disclosed include systems for dynamically coding pulses that represent an excitation signal.

A track or set of tracks that define possible pulse positions are determined based on available information sent to a decoder. The available information is used to determine a track that is likely to define pulse positions at or near pulse signals with high energy, i.e., pulse signals that are likely to contain information that is important for speech processing purposes. As an alternative, at least one first track may include fixed pulse positions, and the remaining tracks may include pulse positions that can change according to the position of a coded pulse in the first track. Another alternative may include dynamically arranging all tracks according to pulse positions that are arranged according to a reference position that is likely to produce a high-energy pulse signal. The reference position can be found from a past excitation signal.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

A system is provided that utilizes dynamic pulse track positions to enhance coded data that, when decoded, produces a synthesized speech signal that resembles an original speech sample. The system typically is used to enhance speech signals transmitted via a wireless communications network. Mobile cellular standards, such as the Adaptive Multi-Rate (AMR) and Selectable Mode Vocoder (SMV) standards, define digital transmission in wireless communication systems. An SMV system is utilized to describe the invention, however, those skilled in the art will appreciate that other systems could be used with the invention, such as AMR. Operation of the SMV system is described in commonly assigned U.S. Patent App., "SYSTEM OF ENCODING AND DECODING SPEECH SIGNALS," by Yang Gao, Adil Beyassine, Jes Thyssen, Eyal Shlomot and Huan-Yu Su, previously incorporated by reference.

Figure 1:
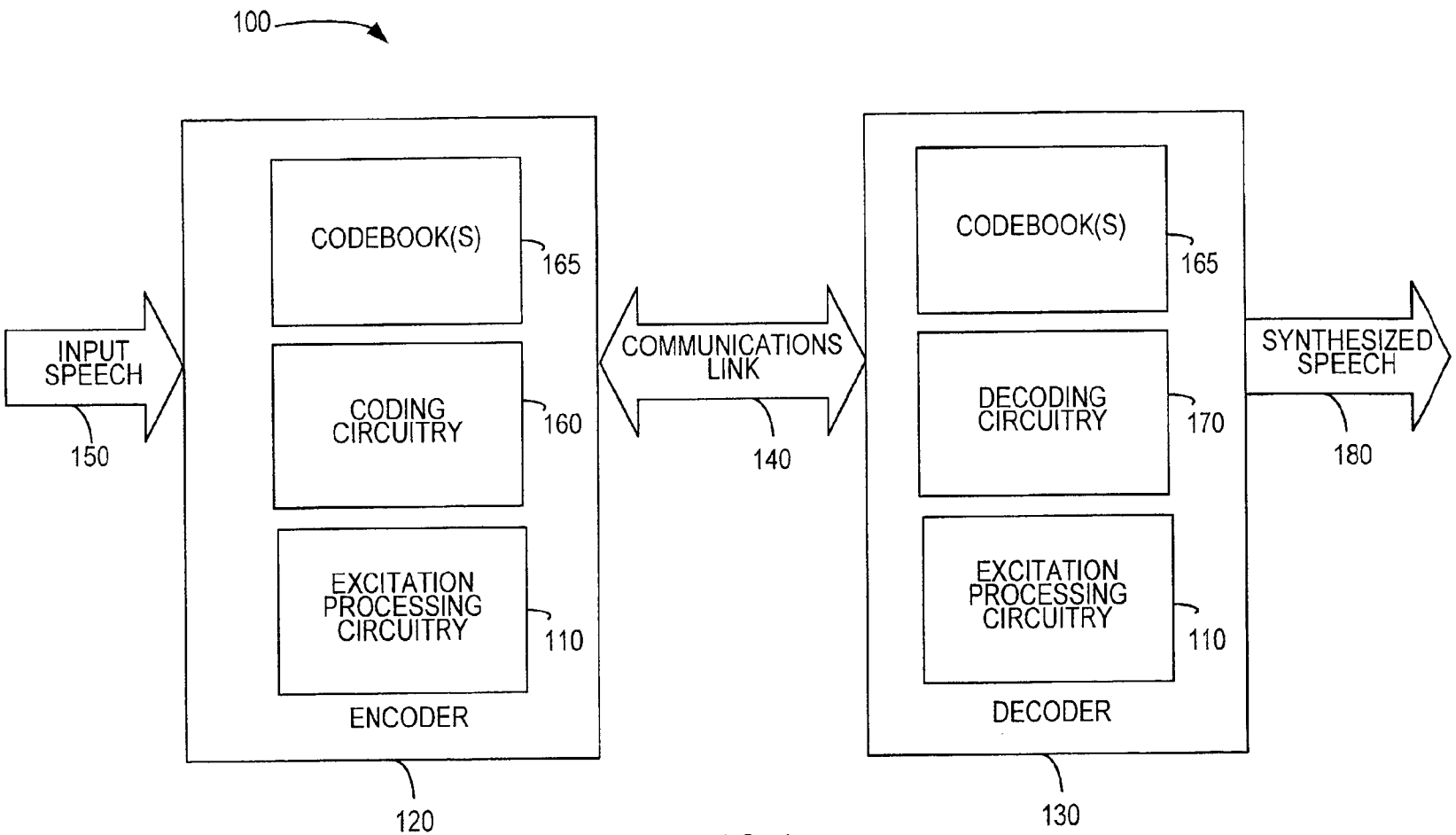
FIG. 1 is a block diagram illustrating an exemplary system that utilizes dynamic pulse track positions of the disclosed embodiments to enhance the quality of the coded pulse data.

FIG. 1 is a block diagram illustrating an exemplary system 100 that utilizes dynamic pulse track positions of the disclosed embodiments to enhance the quality of the coded pulse data. The system 100 includes an encoder 120, a decoder 130 and a communications link 140. In one embodiment, the system includes excitation processing circuitry 110 to dynamically allocate tracks (described in FIG. 2) based on available information, such as signal type information. The SMV system uses type zero to code non-periodic signals and type one to code periodic-like signals. Other types of information could be used such as codebook (described in FIG. 4) and pitch (described in FIG. 5) information. The signal type or other information is sent from the encoder 120 to the decoder 130 via the communications link 140. The communications link 140 is any communication media capable of transmitting voiced data, including but not limited to, wireless communication media, wireline communication media, fiber-optic communication media, and Ethernet. The encoder 120 and decoder 130 may be implemented on one or more integrated circuits (IC), such as a codec (coder/decoder), digital signal processor (DSP) or general processors.

The encoder 120 receives input speech and codes the input speech with coding circuitry 160 to form a coded excitation signal. To reduce the amount of data to be transferred over the communications link 140, the encoder includes a codebook 165 that contains a matrix of values that are used to represent the coded excitation signal. The decoder 130 also includes the codebook 165. To reduce the amount of data sent over the communications link 140, only vector information describing the location of the representative value in the matrix is sent to the decoder, instead of the actual value. The decoder includes decoding circuitry 170 to decode the coded data sent from the encoder 120, to produce synthesized speech 180 that is representative of the input speech 150.

Figure 2:
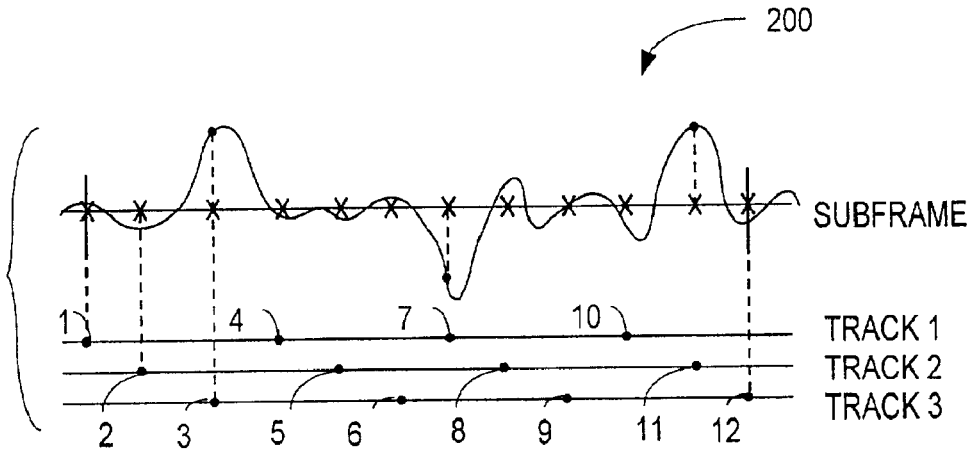
FIG. 2 is a diagram of an exemplary system that uses tracks to code the signals at a low bit rate.

FIG. 2 is a diagram of an exemplary system that uses tracks to code the signals at a low bit rate. In this example, the signal 200 is represented by twelve positions per sub-frame divided between one or more tracks, for example, track 1, track 2 and track 3. More or less pulse positions could be used per sub-frame, such as the forty positions used in the typical SMV system, and the positions can be distributed among more or less tracks. In an ACELP design, tracks are utilized to reduce the possible positions per track for each pulse and thus reduce the amount of bits necessary to represent the pulse.

For example, track 1 includes positions {1, 4, 7, and 10}, track 2 includes positions {2, 5, 8, and 11}, and track 3 includes positions {3, 6, 9, and 12}. Other arrangements of positions per track may be used. In this manner, a pulse is limited to the four possible positions per track. For each track, two bits can be used to code the four possible positions of the pulses, and a sign bit is used to code the magnitude of the pulses, either positive or negative. Thus, only nine bits are needed to code the three pulses for twelve possible positions.

An algorithm is used to determine the position of the pulse per track. An exemplary algorithm is described in a commonly assigned U.S. patent App. entitled "COMPLETED FIXED CODEBOOK FOR SPEECH CODER," Ser. No. 09/156,814, filed Sep. 18, 1998, and is incorporated by reference. Typically, the position is determined according to the pulse having the best closed-loop waveform matching for the possible positions. For example, track 1 includes possible positions {1, 4, 7, and 10}, and the pulse with the best closed-loop waveform matching is located at position 7, thus the algorithm codes the pulse located at position seven (see FIG. 2). In a similar manner, the algorithm codes a pulse located at position 11 for track 2 and codes a pulse located at position 3 for track 3. Thus, three pulses are coded to generate a synthesized excitation that approximately describes the signal for a particular sub-frame.

Figure 3:
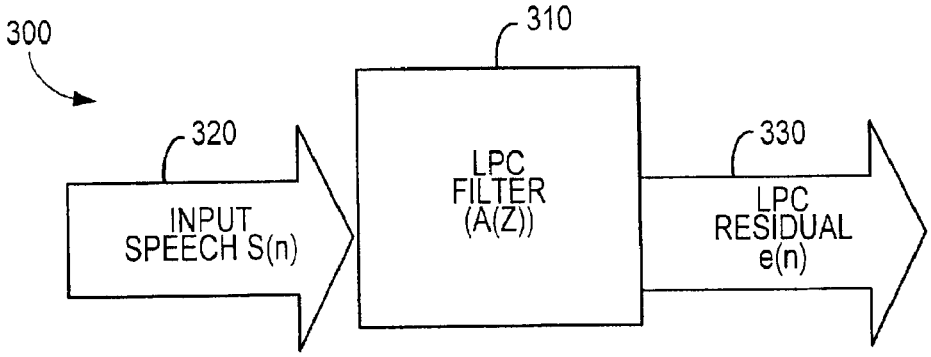
FIG. 3 is a block diagram illustrating an exemplary inverse-filtering system.
Figure 4:
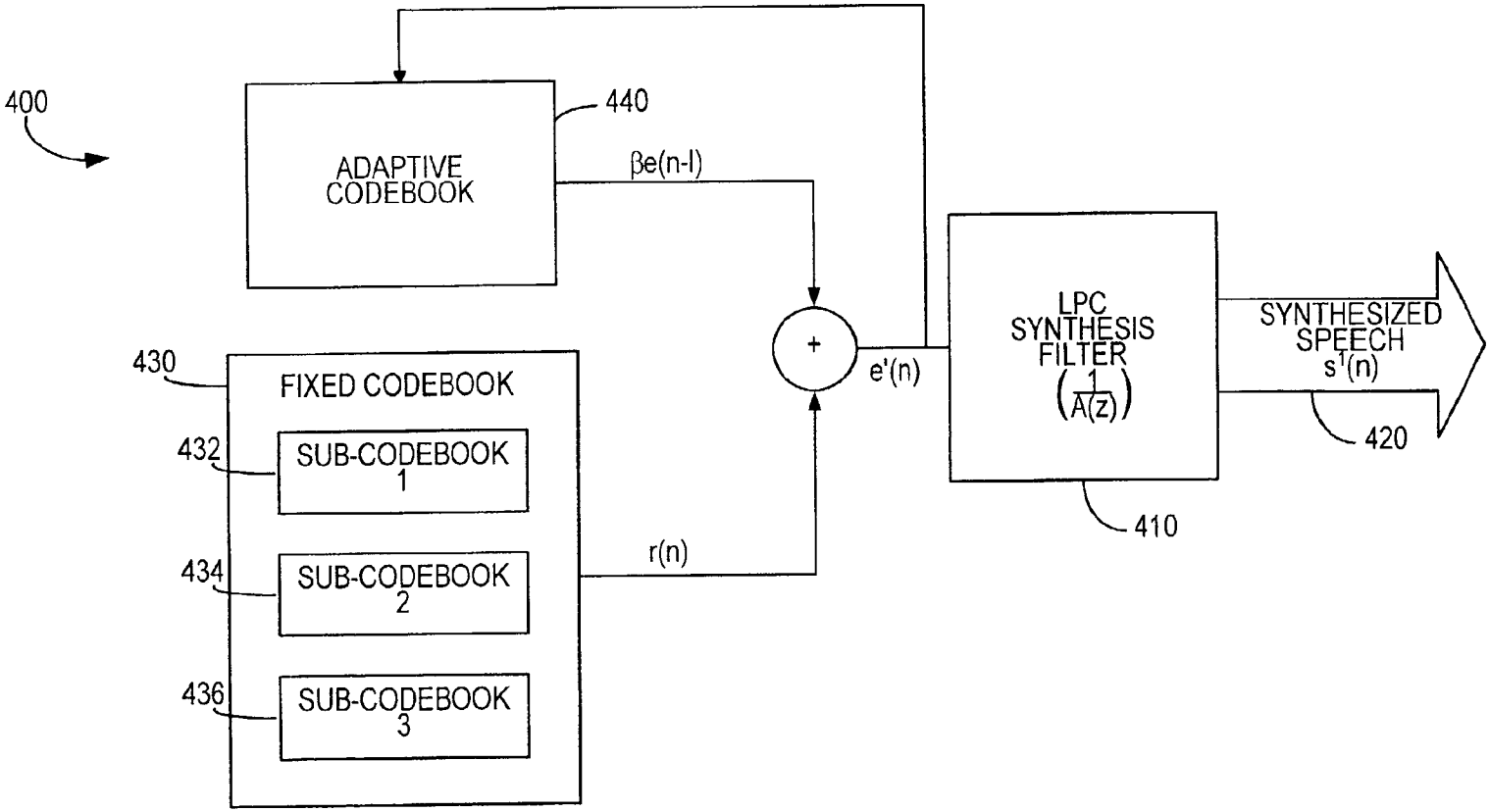
FIG. 4 is a block diagram illustrating a portion of an exemplary coder.

FIGS. 3 and 4 are block diagrams illustrating a portion of an exemplary encoder 300 and decoder 400, respectively. The portion of the encoder 300 includes a linear prediction coding (LPC) filter A(z) 310 that converts input speech s(n) 320 to an LPC residual signal e(n) 330 (discussed in FIG. 5).

The decoder 400 in FIG. 4 includes an LPC synthesis filter (1/A(z)) 410 to convert a synthesized or coded LPC residual signal e' (n) to synthesized speech S' (n) 420.

Figure 5:
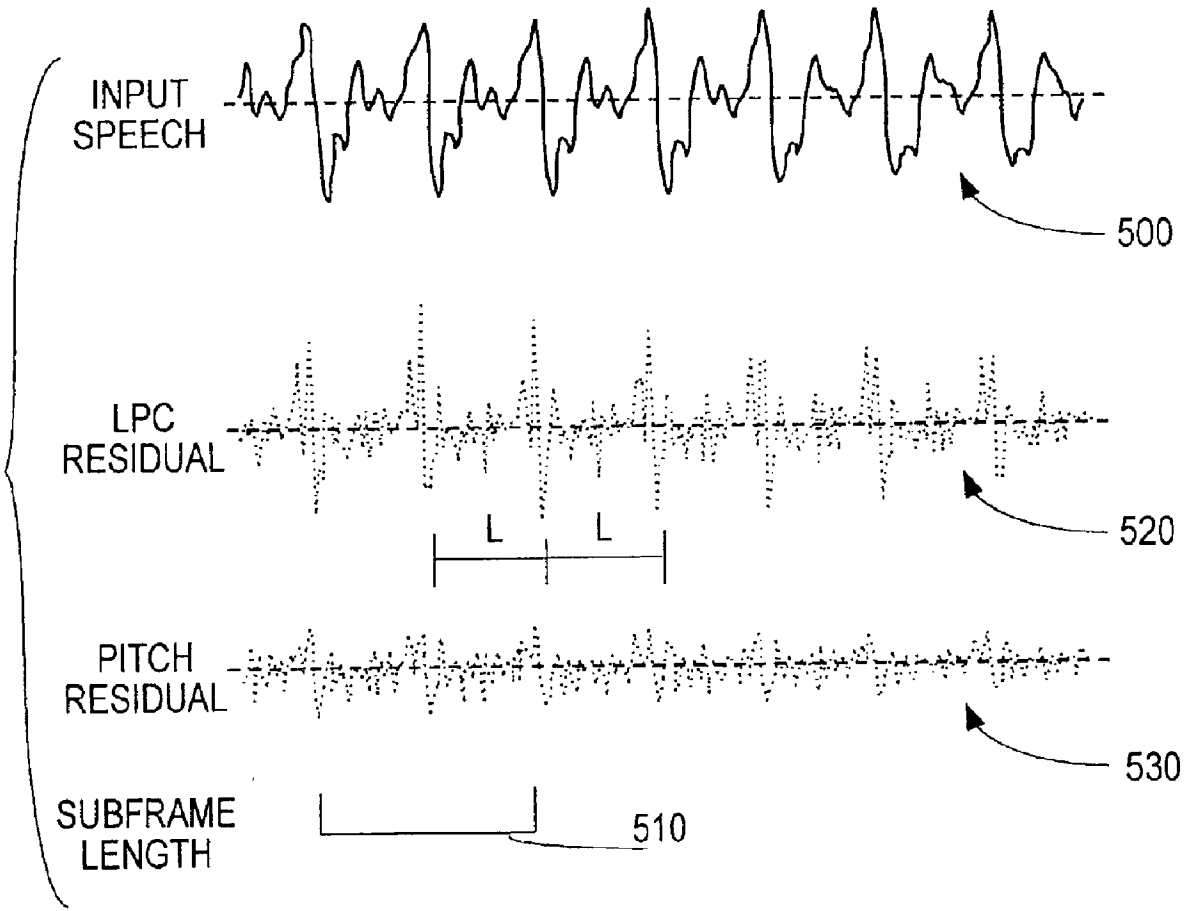
FIG. 5 illustrates an exemplary speech signal and processed signals obtained from the speech signal by removing a short-term LPC correlation and long-term correlation.

FIG. 5 illustrates an exemplary speech signal and processed signals obtained from the speech signal by removing a short-term LPC correlation and long-term correlation. Exemplary methods of LPC include Code Excited Linear Prediction (CELP), eXtended CELP (eX-CELP), and algebraic CELP (ACELP). LPC coding may be a frame-based algorithm that stores sampled input speech signals 500 into blocks of samples called sub-frames 510. An exemplary SMV system operates at a frame size of twenty milliseconds (ms) or one hundred sixty samples per frame. Other sized frames may be used. For signal processing purposes, the frames are divided into sub-frames 510 that are typically forty samples in size. LPC coding represents a given value of input speech 500 using previously measured values. Speech s at an instant n can be approximated by:

$$s(n)\approx a_1 s(n-1)+a_2 s(n-2)+\ldots+a_p s(n-p) \quad \text{(Equation 1)}$$

where $a_1$, $a_2$, . . . $a_p$ are LPC coefficients and p is the LPC order. As stated, Equation 1 is only an approximation of speech s, thus, the difference between the input speech sample and the predicted speech sample is the excitation signal e(n), or a LPC residual 520. The LPC residual 520 can be expressed as:

$$e(n)=s(n)-a_1 s(n-1)-a_2 s(n-2)-\ldots-a_p s(n-p) \quad \text{(Equation 2)}$$

The LPC residual 520 has a level of periodicity similar to the speech signal s(n). The approximately periodic part of the LPC residual 520 is referred to as pitch cycle, where lag L is a measure of the pitch delay in samples. The general shape of the LPC residual 520 is periodic-like for voiced speech and evolves relatively slowly as a function of time, facilitating long-term pitch prediction of the LPC residual 520. Long-term pitch predication is used to determine a pitch residual signal r(n), or pitch residual 530. Pitch residual 530 is defined as the difference between the LPC residual 520 and a pitch prediction contribution, which is expressed as:

$$r(n)=e(n)-\beta e(n-\text{Lag}) \quad \text{(Equation 3)}$$

where β is a pitch prediction coefficient and βe(n−Lag) is the pitch prediction contribution.

FIG. 4 shows, for signal processing purposes, the LPC residual e(n) is processed into the pitch residual signal r(n) and the pitch prediction contribution βe(n−Lag). The pitch residual signal r(n) is coded with a fixed codebook 430 and the pitch prediction contribution βe(n−Lag) is coded with an adaptive codebook 440. The fixed codebook could include sub-codebooks, e.g., sub-codebook one 432, sub-codebook two 434 and sub-codebook three 436, for coding periodic speech-like signals, non-periodic pulse-like signals and random signals, respectively. Any of the sub-codebooks 432, 434 and 436 can use the dynamic tracks and different types of dynamic tracks could be applied according to signal type, as explained in more detail with regard to FIG. 6.

Figure 6:
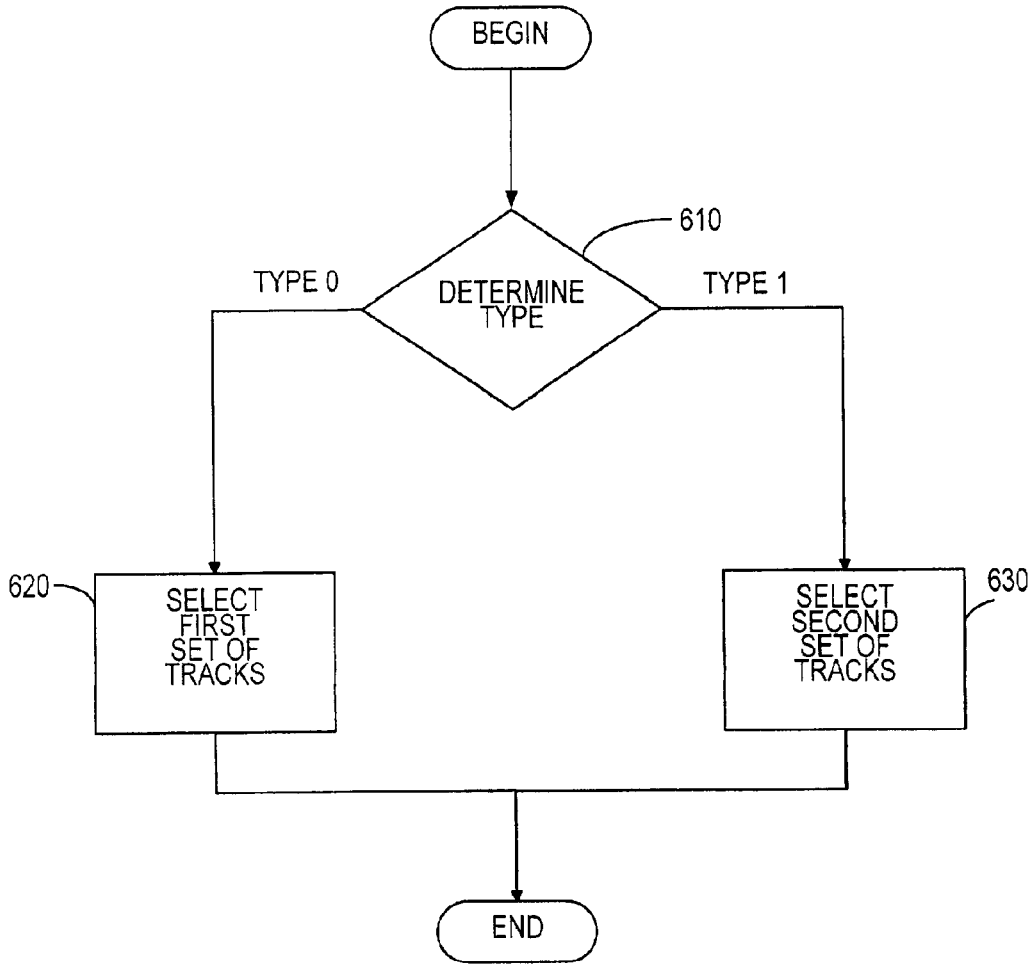
FIG. 6 is a block diagram illustrating an algorithm that assigns a track or set of tracks based on available information, such as a selected signal type.

FIG. 6 is a block diagram illustrating an algorithm that assigns a track or set of tracks based on available information, such as a selected signal type. Information, other than signal type information, could be used such as codebook (adaptive or fixed) information, pitch information and previously coded pulse information (such as pulse position information). In this embodiment, the pulse positions of tracks 1–3 are fixed for a specific sub-frame, but the tracks used to code each pulse can vary. The tracks can vary from one sub-frame to the next sub-frame to better represent changes to the available information. In block 610, a signal type is determined from information available to the decoder 130 (FIG. 1). The signal type is chosen, for example, according to the signal being processed, e.g., whether or not the signal is a periodic-like signal. A track or set of tracks to code the pulsed signal is assigned as a function of the signal type information. In block 620, if type zero is utilized, a first track or set of tracks with set positions is used to code the pulses, and, in block 630, if type one is utilized, another track or set of tracks with fixed positions is selected to code the pulse.

Defining the positions for each track dynamically may be implementation dependent. For example, some tracks include more positions than other tracks, and multiple tracks could include the same position. Also, some tracks could include positions defined towards the beginning of the sub-frame and some tracks could include positions defined towards the middle or end on the sub-frame. For example, track 1 could include positions {1, 2, 3, 4, 5 and 6}, track 2 could include positions {7 and 8} and track 3 could include positions {8, 9, 10, 11 and 12}. A track preferably is selected to include a higher concentration of positions arranged near high amplitude portions of the pitch residual signal r(n), because the high amplitude portion usually includes speech information that is useful to reconstruct the input speech.

Figure 7:
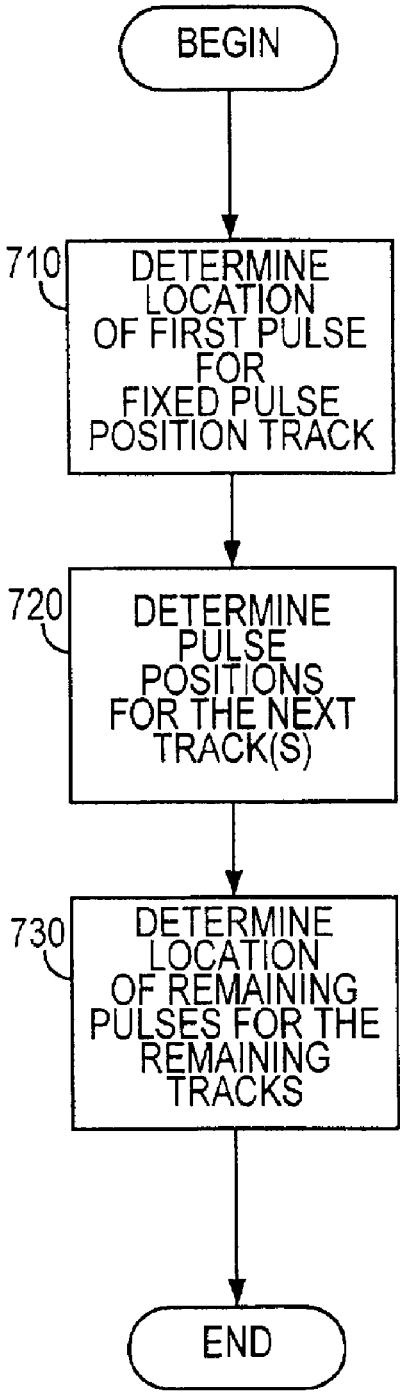
FIG. 7 is a diagram that describes an embodiment of dynamic track allocation in which at least one track includes fixed pulse positions and the remaining tracks include dynamically allocated pulse positions.

FIG. 7 is a diagram that describes an embodiment of dynamic track allocation in which at least one track includes fixed pulse positions and the remaining tracks include dynamically allocated pulse positions. In block 710, for each sub-frame a known algorithm may be used to determine the position of a first pulse in the fixed track with fixed pulse candidate positions, e.g., track 1. An exemplary algorithm is described in a commonly assigned U.S. patent App. entitled "COMPLETED FIXED CODEBOOK FOR SPEECH CODER," Ser. No. 09/156,814, filed Sep. 18, 1998, and is incorporated by reference. In block 720, when the pulse is positioned in track 1, pulse positions are determined for the next track, e.g., track 2. Pulse positions for track 2 may be dynamically constructed based on the coded position of the first pulse in the track 1. In block 730, the locations of the remaining pulses, e.g., third pulse, are determined for the remaining tracks, e.g., track 3, using the dynamically allocated track positions.

The dynamic process accounts for speech signal characteristics. When analyzing the pitch residual signal r(n) and other periodic-like signals, there is a high possibility that significant pulses, i.e., having a high magnitude, are located around the first pulse. By coding the first pulse position and then dynamically specifying candidate pulse positions relative to the first pulse position, the algorithm can allocate more candidate track positions to find the first pulse. The total amount of allocated pulse positions per track is implementation dependent and depends on the amount of bits allowed to define the positions. For example, track 1 includes pulse positions {1, 5, 10, 15, 20 and 25}. If the first pulse is determined at position 10 of track 1, the positions at track 2 are defined at {10−x, 10−y, 10+y and 10+x}, or {6, 8, 12 and 14} if x equals four and y equals two. Likewise, the algorithm may define the pulse positions of track 3 at {10−a, 10−b, 10+b and 10+a}, or {7, 9, 11 and 13} if a equals three and b equals one. Other arrangements are possible.

Figure 8:
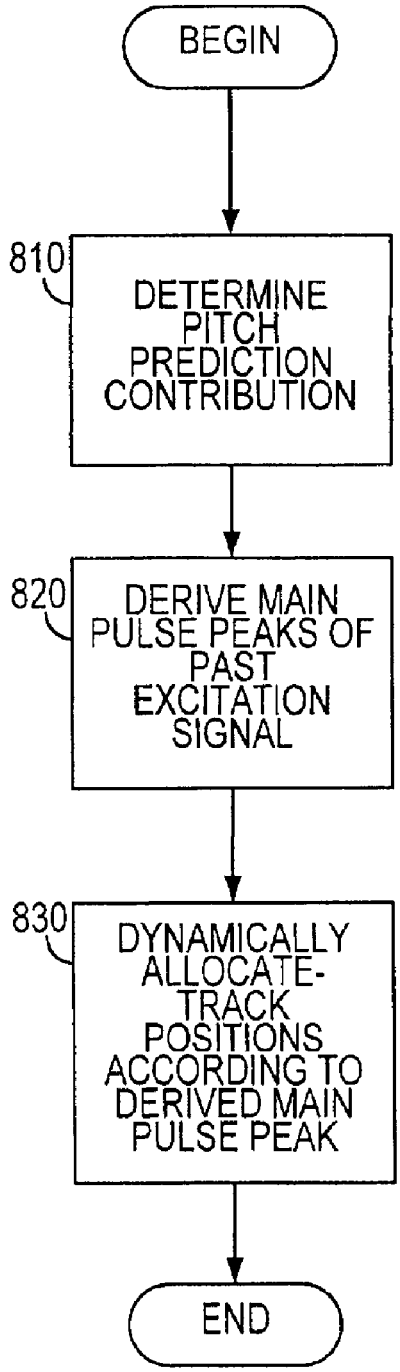
FIG. 8 is a diagram that describes an embodiment of dynamic track allocation in which the algorithm dynamically allocates all pulse positions for all of the tracks.

FIG. 8 is a diagram that describes an embodiment of dynamic track allocation in which the algorithm dynamically allocates all pulse positions for all of the tracks, e.g., track 1, track 2 and track 3. The pitch lag L (FIG. 5) and the pitch coefficient β are determined, for example, using known algorithms. In block 810, the algorithm determines the pitch prediction contribution βe(n−Lag). The pitch prediction contribution βe(n−Lag) typically is coded with the adaptive codebook 440 (FIG. 4).

In block 820, the algorithm of the present embodiment uses information of the pitch prediction contribution βe(n−Lag) to derive an estimation of positions of main peaks from past excitation signals e(n). Because the position of the main peak previously has been coded in the adaptive codebook 440, the derivation of the position of the main peak may occur at either the encoder 120 or the decoder 130 without introducing additional bits into the communication link 140 (FIG. 1). The main peaks are determined using an algorithm. For example, an energy measure algorithm known to those skilled in the art searches all positions of the pitch prediction contribution βe(n−Lag) coded in the adaptive codebook 440 for the position with a peak having the highest energy. In this manner, the discovered main peak location is likely to contain useful information to determine tracks.

In block 830, when the algorithm determines a position of the main peak, the algorithm dynamically constructs candidate pulse positions for each track, e.g., track 1, track 2 and track 3, based on the derived positions of the main peaks. In this manner, if the main peak from a past sub-frame is derived at position 10, track 1 of the current sub-frame is preferably defined as including pulse positions at and around position 10. Different dynamic tracks may be based on different main peak locations. When the first main peak is estimated, an estimate of a second main peak preferably excludes the first peak. In this manner, the pulse positions for track 2 are defined at and around the location of the second main peak for the current sub-frame.

While various embodiments of the invention have been described, it will be apparent to those of ordinary skill in the art that many more embodiments and implementations are possible that are within the scope of this invention. Accordingly, the invention is not to be restricted except in light of the attached claims and their equivalents.

What is claimed is:

1. A speech coding system for encoding a speech signal, the speech coding system comprising:

an encoder that determines a plurality of candidate pulse positions for encoding an excitation signal, wherein the plurality of candidate pulse positions are divided among a plurality of tracks; and an algorithm for execution by the encoder;

wherein the algorithm is configured to assign a first fixed set of candidate pulse positions selected from the plurality of candidate pulse positions to a first track of the plurality of tracks if the algorithm determines that the speech signal is approximately periodic or to assign a second fixed set of candidate pulse positions selected from the plurality of candidate pulse positions to a second track of the plurality of tracks if the algorithm determines that the speech signal is approximately non-periodic;

wherein the algorithm is further configured to assign a dynamic set of candidate pulse positions selected from the plurality of candidate pulse positions to an additional track of the plurality of tracks, wherein the candidate pulse positions in the dynamic set of candidate pulse positions are defined relative to the candidate pulse positions in the assigned fixed set of candidate pulse positions.

2. The system according to claim 1, wherein the encoder includes a fixed codebook having a first sub-codebook for coding the periodic speech signal and a second sub-codebook for coding the non-periodic speech signal.

3. A speech coding system comprising:

a codec that includes an encoder and a decoder, the encoder determines candidate pulse positions to encode a speech signal, where the candidate pulse positions are divided into a plurality of tracks; and an algorithm for execution by the encoder, the algorithm configured to select a first track of the plurality of tracks if the speech signal is approximately periodic and select a second track of the plurality of tracks if the speech signal is approximately non-periodic.

4. The system according to claim 3 where the algorithm determines a first fixed codebook if the speech signal is approximately periodic and determines a second fixed codebook if the speech signal is non-periodic.

5. The system according to claim 4 where the first fixed codebook includes at least one track and the second fixed codebook includes at least one track.

6. A method for coding a speech signal in a speech coding system, comprising;

determining candidate pulse positions, where the candidate pulse positions are divided into a plurality of tracks;

selecting a first track of the plurality of tracks if the speech signal is approximately periodic; and selecting a second track of the plurality of tracks if the speech signal is approximately non-periodic.

7. The method according to claim 6 further comprising:

determining a first pulse position on the first track;

dynamically defining a second pulse position on the second track based on the first pulse position;

defining at least one additional candidate pulse position near the first pulse position.

8. The method according to claim 6 further comprising:

determining a first fixed codebook if the speech signal is approximately periodic; and determining a second fixed codebook if the speech signal is non-periodic.

9. A method for coding a speech signal, the method comprising:

determining candidate pulse positions, where the candidate pulse positions are divided into a plurality of tracks;

selecting a first track of the plurality of tracks if the speech signal is approximately periodic;

selecting a second track of the plurality of tracks if the speech signal is approximately non-periodic;

determining a pitch prediction contribution from a past excitation signal;

determining positions of main peaks according to the pitch prediction contribution; and constructing the candidate pulse positions for at least one dynamic track of a current sub-frame according to the determined positions of the main peaks.

10. The method of claim 9 further including defining candidate positions of a first pulse according to the constructed candidate pulse positions of the at least one dynamic track.

11. The system according to claim 10 where the algorithm defines the first pulse position based on the reference position.

12. The system according to claim 11 where the algorithm further includes an energy measure algorithm to derive one or more additional main peaks.

13. The system according to claim 12 where the energy measure algorithm defines the main peak at a position of the pitch prediction contribution including the highest energy.

14. The method according to claim 9 further including using a pitch prediction contribution to derive the determined positions of the main peaks from a previously encoded signal.

15. The method according to claim 14 further including measuring energy to derive the determined positions of the main peaks.

16. The method according to claim 15 where the energy defines the determined positions of the main peaks at the highest energies.

17. The method according to claim 9 further comprising:

determining a first fixed codebook if the speech signal is approximately periodic; and determining a second fixed codebook if the speech signal is non-periodic.

18. A speech coding system for encoding a speech signal, the speech coding system comprising:

an encoder that determines a plurality of candidate pulse positions for encoding an excitation signal, wherein the plurality of candidate pulse positions are divided among a plurality of tracks; and an algorithm for execution by the encoder;

wherein the algorithm is configured to determine a first pulse position from the plurality of candidate pulse positions on a first track of the plurality of tracks if the speech signal is approximately periodic or to determine a second pulse position from the plurality of candidate pulse positions on a second track of the plurality of tracks if the speech signal is approximately non-periodic, and wherein the algorithm is further configured to define a third pulse position from the plurality of candidate pulse positions on an additional track of the plurality of tracks based on the first pulse position if the speech signal is approximately periodic or the second pulse position if the speech signal is approximately non-periodic.

19. The system according to claim 18 where the algorithm uses a pitch prediction contribution to derive a reference position of a main peak from a previously encoded speech signal to define the first pulse position based on the reference position.

20. The system according to claim 19 where the algorithm defines the first or the second pulse position based on the reference position.

21. The system according to claim 20 where the algorithm further includes an energy measure algorithm to derive one or more additional main peaks.

22. The system according to claim 21 where the energy measure algorithm defines the main peak at a position of the pitch prediction contribution including the highest energy.

23. A speech coding system for encoding a speech signal, the speech coding system comprising:

an encoder that determines a plurality of candidate pulse positions for encoding an excitation signal, wherein the plurality of candidate pulse positions are divided among a plurality of tracks; and an algorithm for execution by the encoder;

wherein the algorithm is configured to determine a first pulse position from the plurality of candidate pulse positions on a first track of the plurality of tracks if the speech signal is approximately periodic or to determine a second pulse position from the plurality of candidate pulse positions on a second track of the plurality of tracks if the speech signal is approximately non-periodic.

24. The system according to claim 23 where the algorithm uses a pitch prediction contribution to derive a reference position of a main peak from a previously encoded speech signal to define the first pulse position based on the reference position.

* * * * *